United States Patent [19]

Miyauchi et al.

[11] Patent Number: 4,772,581

[45] Date of Patent: Sep. 20, 1988

[54] HEAT SENSITIVE RECORDING SHEET

[75] Inventors: Masahiro Miyauchi, Funabashi; Mitsuru Fuchigami, Tokyo, both of Japan

[73] Assignee: Mitsubishi Paper Mills, Ltd., Tokyo, Japan

[21] Appl. No.: 55,329

[22] Filed: May 29, 1987

[30] Foreign Application Priority Data

May 30, 1986 [JP] Japan ..... 61-126691

[51] Int. Cl.[4] ..... B41M 5/18

[52] U.S. Cl. ..... 503/200; 427/150; 427/151; 428/409; 428/913; 503/226

[58] Field of Search ..... 427/150–152; 428/409, 913; 503/200, 226

[56] References Cited

FOREIGN PATENT DOCUMENTS 0115255 9/1979 Japan ..... 503/200

0019549 2/1980 Japan ..... 503/200

*Primary Examiner*—Bruce H. Hess

*Attorney, Agent, or Firm*—Cushman, Darby & Cushman

[57] ABSTRACT

There is provided a heat sensitive recording sheet comprising a support and a heat sensitive color forming layer excellent in mechanical adaptability and recording characteristics and capable of providing clear copies. This recording sheet has a smoothness of at least 150 seconds measured according to JIS P8119, an opaqueness of 30–50% according to JIS P8138 and a stiffness in longitudinal direction of 35 or less in Clark value according to JIS P8143 and the support is a synthetic paper.

2 Claims, No Drawings

HEAT SENSITIVE RECORDING SHEET

BACKGROUND OF THE INVENTION

This invention relates to a heat sensitive recording sheet which has excellent adaptability to various printers and facsimiles and further can provide clear copies by various copying devices.

Since heat sensitive recording system has many characteristics such as non-impact type which generates little noise at recording, no need of development and fixation, simple maintenance, etc., the system has been used for many purposes such as various printers and facsimiles and furthermore, labels, tickets, etc.

Heat sensitive recording sheets used for these purposes are prepared so that they have the characteristics suitable for respective uses and in many cases, not only the heat printed information images are read, but copies are produced therefrom by a copying device or the printed images are sent via facsimile. More specifically, copying systems include various types such as silver salt type, diazo type, electrostatic type, etc., but the main office copying systems now employed are electrostatic types, among which the most popular is the PPC type. However, the diazo type has also high utilization because of low cost and convenience. Further, most of the facsimile devices are provided with copying function.

In order to read thermal printed information images, to make copies from the images by PPC type copying system or to make copies or send the images via facsimile, the images as original must be high in opaqueness, otherwise the device may mistake stains in the portion contacting the backside of the original or color of platen roll for images, resulting in the problems that the stains are also copied or the whole area is printed in black.

On the other hand, when copying is carried out by the diazo type copying system, a long exposure is required to obtain clear images unless opaqueness of the images is low to some extent.

Further, the optical sensors provided in most of facsimile devices for detection of original or recording sheet may make errors unless the opaqueness of original or recording sheet is high to some extent.

When stiffness of recording sheet, especially that of in longitudinal direction is high, it sometimes becomes impossible to lead the top edge of the recording sheet to the desired position during travelling between conveying rolls in the device, resulting in paper sticking.

Problems such as poor printability, curling, etc. are also undesired.

Hitherto, there have been no heat sensitive recording sheets free from these problems.

SUMMARY OF THE INVENTION

An object of this invention is to provide a heat sensitive recording sheet from which clear copies can be made by PPC or diazo type copying system or by facsimile devices and which is superior in mechanical adaptability to electrical transmission and driving by facsimile and recording characteristics such as curling, printability, expansion and cotraction of images.

This invention relates to a heat sensitive recording sheet comprising a support and a heat sensitive color forming layer mainly composed of a colorless or pale-colored dye precursor and a color developer provided on said support wherein the support is a synthetic paper and the recording sheet has a smoothness of at least 150 seconds (JIS P8119), an opaqueness of 30–50% (JIS P8138) and a stiffness in longitudinal direction of 35 or less in terms of Clark value (JIS P8143).

DESCRIPTION OF THE PREFERRED EMBODIMENTS

If necessary, the heat sensitive recording sheet of this invention may be provided with a protective layer or a smooth layer on and/or under the heat sensitive color forming layer or a protective layer on the back side of the recording sheet.

Main materials used in the recording sheet of this invention will be explained in detail below, but this invention should never be limited to them.

The dye precursors include triphenylmethane compounds, fluoran compounds, diphenylmethane compounds, thiazine compounds, spiropyran compounds, etc. As typical examples thereof, mention may be made of Crystal Violet lactone, 3-diethylamino-7-methylfluoran, 3-diethyl-amino-6-chloro-7-methylfluoran, 3-diethylamino-6-methyl-7-chlorofluoran, 3-diethylamino-7-anilinofluoran, 3-diethylamino-7-(2-chloroanilino)fluoran, 3-dibutylamino-7-(2-chloroanilino)fluoran, 3-diethylamino-7-(3-chloroanilino)fluoran, 3-diethylamino-6-methyl-7-anilinofluoran, 3-(N-ethyl-p-toluidino)-6-methyl-7-anilinofluoran, 3-(N-methylcyclohexylamino)-3-methyl-7-anilinofluoran, 3-piperidino-3-methyl-7-anilinofluoran, etc.

As the color developers, there may be used acidic substances which are generally used for heat sensitive recording papers. Examples thereof include phenol, p-t-butylphenol, p-phenylphenol, naphthol, p-hydroxyacetophenone, 2,2′-dihydroxyphenol, 4,4′-isopropylidene(2-t-butylphenol), 4,4′-isopropylidenediphenol, salicylic acid anilide, bis(3-allyl-4-hydroxyphenyl)sulfone, bis(4-hydroxyphenyl)sulfone, 4-hydroxy-4′-isopropoxydiphenylsulfone, novolak type phenolic resin, benzoic acid, p-t-butylbenzoic acid, benzyl p-hydroxybenzoate, methyl p-hydroxybenzoate, etc.

As examples of the binders used in this invention, mention may be made of water-soluble binders such as starches, hydroxyethyl cellulose, methyl cellulose, carboxymethyl cellulose, gelatin, casein, polyvinyl alcohol, modified polyvinyl alcohol, styrene-maleic anhydride copolymer, ethylene-maleic anhydride copolymer, etc. and latex type water-insoluble binders such as styrenebutadiene copolymer, acrylonitrile-butadiene copolymer, methyl acrylate-butadiene copolymer, etc.

As the pigments, there may be used, for example, diatomaceous earth, talc, kaolin, calcined kaolin, calcium carbonate, magnesium carbonate, titanium oxide, zinc oxide, silicon oxide, aluminum hydroxide, urea-formalin resin, etc. The kind and amount of pigment used have especially great effects on opaqueness.

In addition, there may be used metallic salts of higher fatty acids such as zinc stearate, calcium stearate, etc., waxes such as paraffins, oxidixed paraffins, polyethylene, polyethylene oxide, stearic acid amide, castor wax, etc., wetting agents such as dioctyl sulfosuccinate, etc., ultraviolet absorbers such as benzophenone type, bezotriazole type, etc., surface active agents, fluorescent dyes, etc.

The support must satisfy all the requirements that the heat sensitive recording sheet comprising the support on which a heat sensitive color forming layer is provided has a smoothness of 150 seconds or more, an opaqueness of 30–50% and a stiffness in longitudinal direction of 35 or less in terms of Clark value. The most preferred are translucent synthetic papers made of, e.g., polypropylene as a main component to which inorganic fillers and the like are added, considering the problems of curl, expansion and contraction and creases produced at the time of coating, easiness in control of smoothness by calender at finishing, and expansion and contraction of support caused by heat.

When the smoothness of the heat sensitive recording sheet is less than 150 seconds, close contact with a thermal head cannot be attained, resulting in reduction of color density and inferior printability.

When the opaqueness of the recording sheet is less than 30%, in the case of using the imaged recording sheet as an original for copying or electrotransmission, copying device or transmission device may mistake a stain in the portion which contacts with the back side of the sheet or color of a platen roll for an image and as a result, the stain may also be copied or the whole area may be printed in black. Furthermore, when copies are made by diazo type copying system, density of copied image is low. Besides, the original per se may be illegible. On the other hand, when the opaqueness is more than 50%, in the case of using the imaged sheet as an original for copying by the diazo type copying system, exposure of a long time is required or fog is produced in the white background part.

When stiffness (especially in longitudinal direction) is more than 35, it becomes impossible to lead the front edge of the recording sheet to the desired position during travelling between conveying rollers in devices, resulting in discontinuance of feeding of the sheet. Furthermore, contact with a thermal head becomes insufficient to cause decrease of color density and inferior printability.

Smoothness, opaqueness and stiffness of the recording sheet were measured by the following methods.

1. Smoothness: Smoothness test method for paper and boad by Bekk smoothness tester (JIS P8119)

The smoothness was measured by BEKK SMOOTHNESS TESTER manufactured by Kumagaya Riken Kogyo Co. and indicated by time required for 10 ml of air to pass between a face of a glass and a face of a test piece using a pressing pressure of 1 Kgf/cm$^2$ [95 kPa] in an atmosphere of a temperature of 20°±2° C. and a humidity of 65°±2%.

2. Opaqueness: Opaqueness test method for paper (JIS P8138)

The opaqueness was measured by HUNTER REFLECTOMETER manufactured by Toyo Seiki Seisakusho Co. using a green filter, (a) a white plate of 89% in reflectance when green filter is used and (b) a black plate of less than 0.5% in reflectance when a green filter is used as backing plates and five test pieces of 100×80 mm (the long side is taken as the longitudinal direction of the paper) and in the following manner.

(1) The test piece was superposed on the white backing plate and reflectance ($R_{0.89}$) was measured. In this case, the plane formed by incident light and reflected light was in the longitudinal direction of the test piece and the top side of the test piece was allowed to face to the incident light.

(2) Then, the test piece was superposed on the black backing plate and reflectance ($R_0$) was similarly measured.

(3) The opaqueness was calculated by the following equation (method A):

$$C = \frac{R_0}{R_{0.89}} \times 100\ (\%)$$

Average value of measurements on five test pieces was taken as opaqueness of the recording sheet.

3. Stiffness: Gravity flexing method for paper (JIS P8143) (Clark method)

The stiffness was measured by CLARK STIFFNESS TESTER TYPE D using five test pieces of 50 mm width and 75 mm or more length and in the following manner (method A).

(1) A test piece was inserted at a right angle between clamping rolls of the accurately horizontally placed tester and the clamp was rotated at a rotation angular velocity of about 90° /15 sec.

(2) At a rotating angle of 90°±2°, the length of the test piece projected from the rolls was adjusted so that the projected test piece fell down.

(3) The length (L) of the projected portion from a tangent line of the rolls was measured in 0.1 cm unit (by a metallic scale).

(4) The stiffness was calculated by the following equation.

$$\text{Stiffness}\left(\frac{\text{cm}^3}{100}\right) = \frac{L^3}{100}$$

The following Example 1 and Comparative Examples 1–3 explain this invention in more detail, wherein "part" and "%" are by weight unless otherwise notified.

| | |
|---|---|
| Solution A | |
| 3-Diethylamino-6-methyl-7-anilinofluoran | 12 parts |
| 10 wt % aqueous polyvinyl alcohol solution | 18 parts |
| water | 30 parts |
| Solution B | |
| Benzyl p-hydroxybenzoate | 40 parts |
| Dibenzyl-4,4'-(ethylenedioxy)dibenzoate | 10 parts |
| Zinc stearate | 8 parts |
| 10 wt % aqueous polyvinyl alcohol solution | 87 parts |
| Water | 48 parts |

Solution A and solution B were milled and dispersed in separate ball mills for 48 hours and then a coating composition for heat sensitive layer was prepared in the following formulation.

| | |
|---|---|
| Calcium carbonate | 20 parts |
| Solution B | 60 parts |
| 10 wt % polyvinyl alcohol | 70 parts |
| Solution A | 20 parts |
| Water | 60 parts |

Thus prepared coating composition was coated on the following four supports (a, b, c and d) at a coating amount of about 5 g/m$^2$ after drying and these coated samples were subjected to calendering under same conditions to make heat sensitive recording sheets.

The four supports were as follows:

(a): A synthetic tracing paper of 60μ thick (trade name: YUPO TPG #60 manufactured by Oji Yuka Goseishi Co.)

(b): A tracing paper of 60μ thick (trade name: DX Tracing Paper N manufactured by Mitsubishi Paper Mills Ltd.)

(c): PET film of 75μ thick (d): A high quality paper of 60μ thick

Characteristics: Smoothness, opaqueness and stiffness in longitudinal direction (Clark method) of heat sensitive recording sheet A made by coating on support (a) (sample of this invention) and heat sensitive recording sheets B, C and D made by coating on supports (b), (c) and (d) (comparative samples) were measured. The results are shown in Table 1.

TABLE 1

| Example No. | Sheet No. | Smoothness (sec) | Opaqueness (%) | Stiffness |
|---|---|---|---|---|
| Example 1 | A | 310 | 42.4 | 12.6 |
| Comparative Example 1 | B | 87 | 44.0 | 22.0 |
| Comparative Example 2 | C | 6000 | 28.8 | 40.2 |
| Comparative Example 3 | D | 238 | 74.9 | 19.1 |

Test 1

The heat sensitive recording sheets A, B, C and D obtained above were subjected to printing by a heat sensitive facsimile tester (manufactured by Matsushita Denshi Buhin Co.) under the conditions of an applied pulse width of 2.5 msec and an applied voltage of 16.0 V. Copies were produced using these prints as originals by a diazo copier (trade name: COPINIkA Pd-521 manufactured by Bunshodo Co.). Color densities of background portion and printed image portion of these copies were measured by Macbeth densitometer RD-514 and printability was also examined. The results are shown in Table 2.

TABLE 2

| Example No. | Density of background | Density of image | Printability |
|---|---|---|---|
| Example 1 | 0.14 | 0.60 | o |
| Comparative Example 1 | 0.16 | 0.51 | x |
| Comparative Example 2 | 0.16 | 0.23 | x |
| Comparative Example 3 | 0.51 | 0.84 | o |

o . . . Good
x . . . Bad

Test 2

Copies were produced using the heat sensitive recording sheets A, B, C and D printed by heat sensitive facsimile tester in Test 1 as originals by a PPC copier (trade name: UBIX 2500MR manufactured by Konishiroku Photo. Ind. Co., Ltd.). Only the copy obtained from the heat sensitive recording sheet C was stained in the background portion and the images were illegible.

Text 3

The heat sensitive recording sheets A, B, C and D were examined on running property during electro-transmission by a facsimile (trade name: PANAFAX UF-920 manufactured by Matsushita Denso Co.), curling and printability. The results are shown in Table 3.

TABLE 3

| | Running property | Curl | Printability |
|---|---|---|---|
| Example 1 | o | o | o |
| Comparative Example 1 | Δ | x | x |
| Comparative Example 2 | x | x | x |
| Comparative Example 3 | o | o | o |

"o" . . . Good,
"Δ" . . . Somewhat bad,
"x" . . . Bad

The problems which occurred in the recording sheets were specifically as follows:

B: Discontinuance of travelling of sheets to cause sticking of sheets.

C: Misworking of alarm for replacement of recording sheets which occurred because presence of recording sheet could not be sensed.

Thus, according to this invention, there is provided a heat sensitive recording sheet comprising a dye precursor and a color developer which has superior adaptability to various printers and facsimiles and which can provide clear copies by various copiers.

What is claimed is:

1. A heat sensitive recording sheet comprising a support and, provided thereon, a heat sensitive color forming layer mainly composed of a colorless or pale-colored dye precursor and a color developer wherein said support is a synthetic paper and said heat sensitive recording sheet has a smoothness (JIS P8119) of 150 seconds or more, an opaqueness (JIS P8138) of 30–50% and a stiffness in longitudinal direction in Clark value (JIS P8143) of 35 or less.

2. A heat sensitive recording sheet according to claim 1 wherein the support is a synthetic paper made of a polypropylene resin as a main raw material and an inorganic filler.

* * * * *